US008490585B2

(12) United States Patent
Kienzle et al.

(10) Patent No.: US 8,490,585 B2
(45) Date of Patent: Jul. 23, 2013

(54) WORK APPARATUS WITH A COMBUSTION-AIR FLOW DIVERTED FROM THE COOLING AIR FLOW

(75) Inventors: Wolfgang Kienzle, Remseck (DE); Martin Rieber, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 334 days.

(21) Appl. No.: 12/923,743

(22) Filed: Oct. 6, 2010

(65) Prior Publication Data

US 2011/0100308 A1 May 5, 2011

(30) Foreign Application Priority Data

Oct. 30, 2009 (DE) ..... 10 2009 051 356

(51) Int. Cl.
*F01P 7/00* (2006.01)

(52) U.S. Cl.
USPC ..... 123/41.58; 123/41.6; 123/41.65; 123/195 C; 123/198 E; 55/337; 55/437; 55/473; 55/392

(58) Field of Classification Search
USPC ..... 123/41.65, 41.6, 41.62, 195 C, 198 E, 123/41.58, 41.59; 55/337, 437, 473, 392
See application file for complete search history.

(56) References Cited

U.S. PATENT DOCUMENTS 5,269,265 A * 12/1993 Pretzsch et al. ..... 123/41.56
5,343,831 A * 9/1994 Collins ..... 123/41.65
5,363,815 A * 11/1994 Pretzsch et al. ..... 123/41.7
5,367,988 A * 11/1994 Collins ..... 123/41.65
5,526,777 A * 6/1996 Taomo et al. ..... 123/41.65
5,542,380 A * 8/1996 Chatten ..... 123/41.7
5,582,146 A * 12/1996 Linsbauer et al. ..... 123/198 E
5,720,243 A * 2/1998 Stegemyr et al. ..... 123/198 E
6,192,840 B1 * 2/2001 Durr et al. ..... 123/41.65
6,295,953 B1 * 10/2001 Ohsawa et al. ..... 123/41.7
6,314,922 B1 * 11/2001 Zimmermann et al. ... 123/41.65
6,681,726 B2 * 1/2004 Linsbauer et al. ..... 123/41.65
6,868,821 B2 * 3/2005 Maier et al. ..... 123/198 E
6,948,457 B2 * 9/2005 Maier et al. ..... 123/41.65
7,513,223 B2 * 4/2009 Onodera et al. ..... 123/41.7
7,694,655 B2 * 4/2010 Sagara et al. ..... 123/41.7

* cited by examiner

*Primary Examiner* — Noah Kamen
*Assistant Examiner* — Grant Moubry
(74) *Attorney, Agent, or Firm* — Walter Ottesen P.A.

(57) ABSTRACT

The invention relates to a portable, hand-held work apparatus such as a chain saw, a cut-off machine, a brush cutter or the like with an air cooled combustion engine. A cooling air blower (4) which includes a cooling air spiral (6) and a fan wheel (5), moves a cooling air flow (13) for cooling the combustion engine. Further a combustion air channel (30) leads from the cooling air blower (4) to the combustion engine (2) and branches off from an air output window (20) provided in the base (14) of the cooling air spiral (6). The diverting device (21) includes a guide wall (22) which extends into the cooling air spiral (6) between the fan wheel (5) and the air output window (20). In order to divert a large volume of combustion air (19) with minimal disruption to the cooling air flow, the pass-through cross-section of the air output window (20) tapers in the direction of the diverted combustion air (19) from a first pass-through area (29) to a second pass-through area (31).

4 Claims, 3 Drawing Sheets

WORK APPARATUS WITH A COMBUSTION-AIR FLOW DIVERTED FROM THE COOLING AIR FLOW

CROSS REFERENCE TO RELATED APPLICATION

This application claims priority of German patent application no. 10 2009 051 356.6, filed Oct. 30, 2009, the entire content of which is incorporated herein by reference.

FIELD OF THE INVENTION

The invention relates to a work apparatus with an air-cooled combustion engine, especially a portable hand-held work apparatus such as a chain saw, a cut-off machine, a brush cutter or the like.

BACKGROUND OF THE INVENTION

It is known to arrange a diversion device in the cooling air spiral for supplying combustion air to the engine. This diversion device can also be referred to as a pre-separator. The air outlet window of the diversion device is shielded from the fan wheel via a guide wall, so that the air outlet window is for the most part in the flow shadow of the feeding fan wheel. The cooling air flowing to the combustion engine via the air outlet window is sucked in by the combustion engine via the air outlet window as combustion air. Because of the arrangement and position of the window, the combustion air flow is largely free from dirt particles and dust.

The cooling air blower with cooling air spiral and fan wheel is configured to sufficiently cool the combustion engine under a continuous load. Because the diversion device or pre-separator device is located in the cooling air spiral, the form and size thereof must be so configured that the cooling air flow itself is disrupted as little as possible so that sufficient cooling of the combustion engine is ensured in every operating state.

On the other hand, the diversion device or pre-separator is configured such that a sufficient volume of combustion air flows to the combustion engine. A diversion device, matched to the desired dynamic pressure and the desired amount of combustion air supplied, can, however, lead to a significant disruption of the cooling air spiral and the cooling air flow so that the sufficient cooling of the combustion engine is jeopardized.

SUMMARY OF THE INVENTION

It is an object of the invention to divert by simple means an appropriate amount of combustion air via a diversion device from the cooling air spiral in a work apparatus with an air cooled combustion engine and thereby ensure that the diversion device creates no significant disruption of the cooling air flow from the cooling air blower to the combustion engine.

The work apparatus of the invention includes: an air cooled combustion engine; a cooling air blower having a fan wheel and a cooling air spiral having a base; the cooling air blower being configured to generate a cooling air flow in a flow direction; an air output window having a pass-through cross-section arranged in the base of the cooling air spiral; a combustion air channel branching off from the air output window and leading from the cooling air blower to the combustion engine for conducting combustion air to the combustion engine in a flow direction; a guide wall projecting into the cooling air spiral and extending between the fan wheel and the air output window; and, the pass-through cross-section of the air output window tapering in the flow direction-of the combustion air from a first pass-through area to a second pass-through area.

Surprisingly, it has been shown that despite a tapering of the large pass-through area of the air outlet window in the flow direction of the combustion air to a smaller pass-through area of the combustion air channel, an improved combustion air flow with increased volume is achieved without the cooling air flow being affected in a noticeable manner. An acceleration of the air masses results because of the tapering of the pass-through cross-section in the direction toward the combustion air channel.

Practically, the tapering of the pass-through area is continuous to avoid disrupting flow conditions such as turbulence.

In an advantageous embodiment, at least one edge of the air outlet window is configured as a surface that slopes downward into the air channel. The sloping surface can for the most part form a straight or even surface. It can also be practical to configure the downward sloping surface as a curve or a surface with a plurality of steps.

The downward sloping surface is formed on a longitudinal edge of the air outlet window and, in this way, the sloping surface extends essentially in the longitudinal direction of the flow of the cooling air. The longitudinal edge of the air outlet window is opposite the guide wall. The other longitudinal edge is formed by the guide wall itself.

In a further embodiment of the invent-ion, the guide wall is formed with a roof section which overlaps the air outlet window at a distance. A radial end section, which extends along a back radial edge of the air outlet window, is formed at the front end, in the flow direction, of the guide wall. As a result of this configuration of the guide wall, an open pocket is formed in which portions of the cooling air become trapped and thereby create a dynamic pressure above the air outlet window which promotes the outflow of combustion air without significantly disrupting the cooling air flow.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
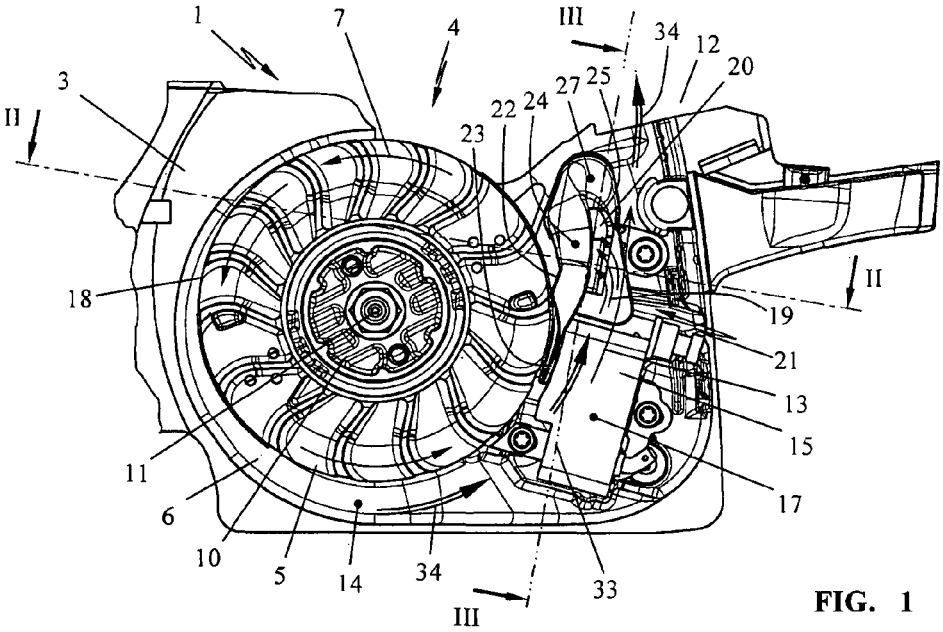
FIG. 1 is a view of an opened cooling air blower for a portable, hand-held work apparatus.
Figure 2:
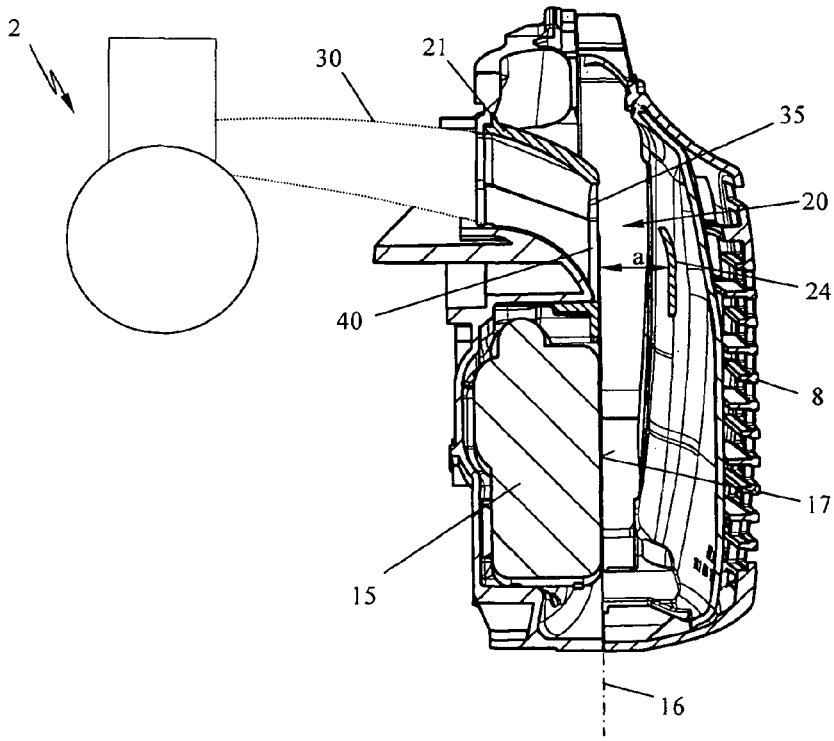
FIG. 2 is a section view along line II-II of FIG. 1.

The cooling air blower 1 shown in FIG. 1 is part of a work apparatus, not shown in detail here, with an air cooled combustion engine 2, which is shown schematically in FIG. 2. A work apparatus of this type, in particular, is a portable hand-held work apparatus such as a chain saw, a cut-off machine, a brush-cutter, a blower, or the like.

Figure 3:
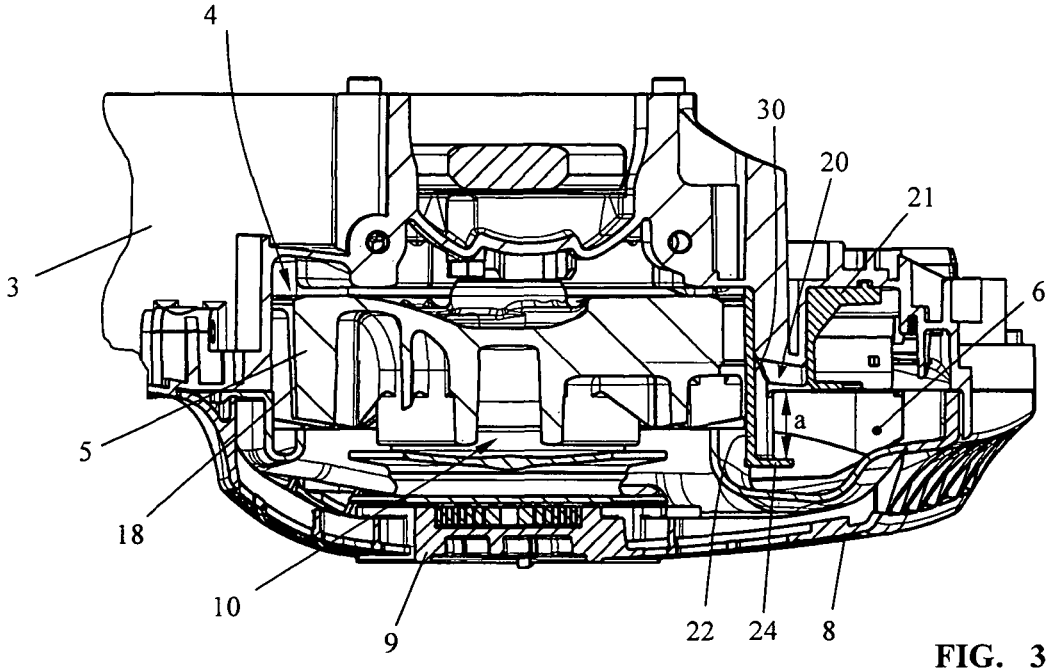
FIG. 3 is a section view along line III-III of FIG. 1.

The housing part 3 shown in FIG. 1 is part of the housing of the work apparatus and accommodates a cooling air blower 4, which includes a fan wheel 5 and a cooling air spiral 6. As FIG. 3 shows, the cooling air blower 4 is covered by a ventilation grid 8, which in the shown embodiment contains a pull cord starter 9 which engages the hub 10 of the fan wheel 5 to start the combustion engine. The fan wheel 5 is fixedly mounted on the crankshaft 11 of the combustion engine and rotates therewith.

As FIG. 1 shows, the cooling air spiral extends over a peripheral angle from about 300° to about 320° in rotational direction 7 of the fan wheel 5. The cooling air spiral widens in the direction of its blower outlet opening 12.

Seen in the flow direction 13 of the conveyed cooling air 34, an air outlet window 20, which is preferably embedded in the base 14 of the cooling air spiral 6, is provided in front of the outlet opening 12 approximately in the area from 220° to 320° of the cooling air spiral 6. In the flow direction 13 of the cooling air 34, an ignition module 15 of the combustion engine lies in front of the air outlet window 20. The ignition module 15 is flowed-over by the cooling air 34 of the cooling air blower 4.

The air outlet window 20 lies, as FIG. 2 shows, in one plane 16 with the surface 17 of the ignition module 15. The cooling air 34, which sweeps over the ignition module 15, thereby flows in a plane 16 in which the air outlet window 20 also lies.

Figure 4:
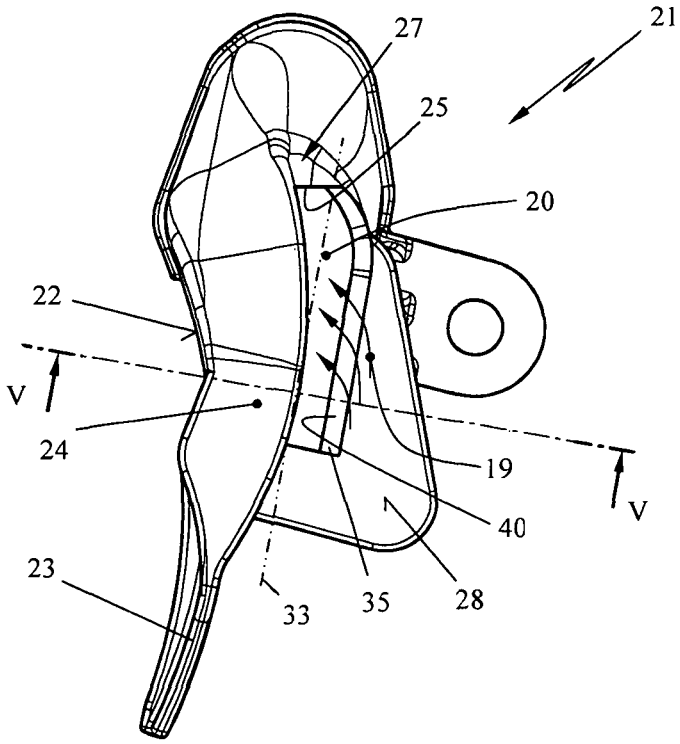
FIG. 4 is an enlarged view of a diversion device for combustion air from the cooling air blower; and, FIG. 5 is a section view through the diversion device along line V-V of FIG. 4.
Figure 5:
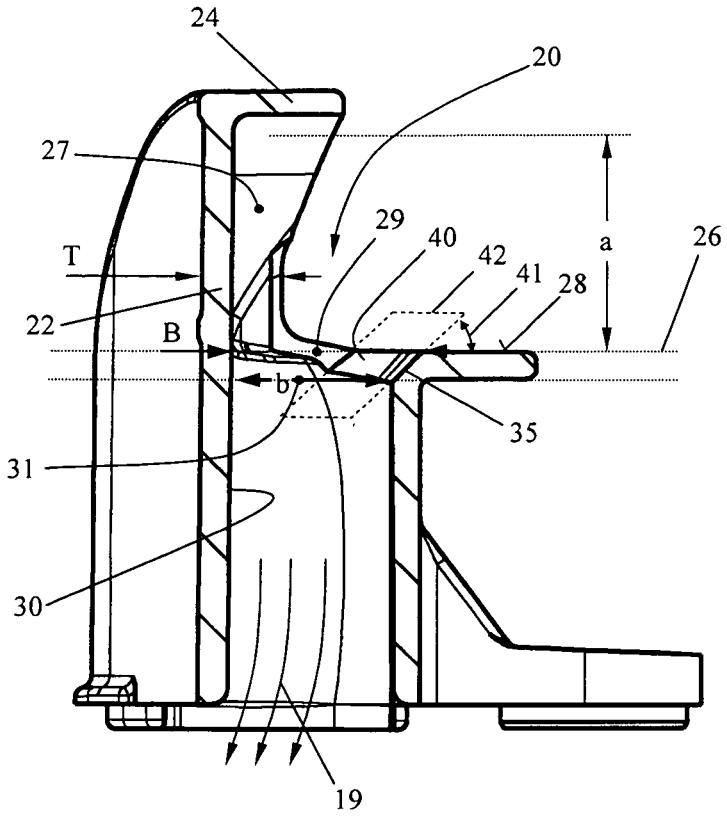

The air outlet window 20 is part of a diversion device 21 which is shown in FIGS. 4 and 5.

As FIGS. 1 to 3 in connection with FIGS. 4 and 5 show, the diversion device 21 includes a guide wall 22, whose initial section 23 lies close to the outer periphery 18 of the fan wheel 5. The guide wall 22 extends over a peripheral angle of about 45° and is approximately aligned with the flow direction 13 of the cooling air 34, so that the guide wall 22 is as minimal a source of disruption as possible in the cooling air flow.

The guide wall 22 lies between the fan wheel 5 and the air outlet window 20, so that the air masses, which are radially moved by the fan wheel 5, cannot directly enter the air outlet window 20.

To further cover the air outlet window 20 against a direct entry of air, on its longitudinal edge facing the cooling air grid 8, the guide wall 22 has a roof section 24, which begins behind the initial section 23 and extends over the outlet window 20 up to the outlet window's back edge 25. The roof section 24 lies above the plane 16 and/or above plane 26 (FIG. 5) of the air outlet window 20 at a distance (a) and projects—as seen from the top-view according to FIG. 4—over about half the radial width of the essentially rectangular air outlet window 20.

In the flow direction 13 of the cooling air 34, the guide wall 22 has a back end section 27, which extends approximately radially behind the air outlet window 20 transversely to the flow direction 13 and projects over only a portion of the width of the air outlet window 20.

As FIG. 5 shows, the end section 27 has a width T, which corresponds to a portion of the width B of the air outlet window 20.

The cooling air 34 moved in the cooling air spiral 6 in accordance with the rotational direction 7 of the fan wheel 5 sweeps over the ignition module 15 and the base 28 of the diversion device 21. Thereby, a portion of the cooling air 34 becomes trapped in the region of the rear end section 27 of the guide wall 22 and builds dynamic pressure above the air outlet window 20, which pressure assists the flow of the combustion air 19 to be branched off through the combustion air channel 30. The configuration of the rear end section 27 of the guide wall 22 is designed such that the effect of the cooling air blower is not disrupted by the diversion of combustion air 19.

The layout is arranged such that the necessary volume of combustion air 19 and additionally a surplus volume with a corresponding dynamic pressure are available, so that a sufficient amount of combustion air flows to the combustion engine 2, even at maximum suction capacity. The ratio of the diverted combustion air 19 to the moved cooling air 34 is about 10% to 90%.

In order to increase the volume of diverted combustion air 19, without increasing the size of the diversion device 21 and thus impairing the cooling air flow in the cooling air spiral 6, the pass-through cross-section of the air outlet window 20 is configured large. The pass-through cross-section is reduced from a first pass-through area 29 to a second pass-through area 31 following in flow direction, whereby the structured size of the diversion device 21 remains small and unchanged. Geometrically, thereby, a component results as a diversion device 21, whose combustion air channel 30 tapers in the flow direction of the combustion air 19 from an inflow section of the provided air outlet window 20 from the outer plane 26 of the base 28 to a smaller pass-through cross-section of the discharging section of the combustion air channel 30. The size of the air trapping pass-through cross-section 29 of the air outlet opening 20 is thereby increased.

The size of the diversion device 21 is substantially determined by the pass-through area 31 and/or the dimension (b) (FIG. 5) of the combustion air channel 30. In order to not change the size or to keep it small, the in-flow section of the pass-through area 29 of the air outlet window 20 tapers to the pass-through area 31 of the discharging combustion air channel 30.

The tapering of the in-flow section is configured to be continuous, wherefore, in an embodiment, at least one edge 35 of the air outlet window 20 is configured as a sloping surface 40 in the air channel 30. Other configurations such as a rounding or a surface having a plurality of steps can be practical. In the shown embodiment, the sloping surface 40 essentially forms a plane 42, which lies at an angle 41 of about 40° to 50° to the longitudinal axis 32 of the discharging combustion air channel 30.

The basic form of the air outlet window 20 seen in top-view is about rectangular. The large longitudinal axis 33 of the rectangle extends approximately in the main flow direction 13 of the cooling air 34 and the small axis of the rectangle lies approximately radially to the fan wheel 5. The guide wall 22 thereby forms, as shown in FIGS. 4 and 5, the one longitudinal edge of the air outlet window 20, while the longitudinal edge 35 opposite to the guide wall 22, is formed in such a manner that the pass-through cross-section of the air outlet window 20 tapers in the flow direction of the diverted combustion air 19 from a first pass-through area 29 to a second pass-through area 31. In the shown embodiment according to FIG. 5, the rectangular air outlet window 20 has a width B in the plane 26 of the base 28 of the diversion device and tapers to a width (b) at the transition to the combustion air channel 30 which is transverse to the longitudinal axis 33 of the air outlet window 20.

Because of the tapering of the in-flow section, which connects to the air outlet window 20, a large through-flow cross-section can be formed in the entry area in the plane of the base 28, which leads to a larger volume of diverted combustion air. The pass-through cross-section which decreases in the flow direction leads to an increased flow speed. The entire configuration is such that the inlet bevel or the bevel 40 sloping down into the air outlet window 20 accelerates the through-flowing combustion air 19 to minimize a throttling effect.

It is understood that the foregoing description is that of the preferred embodiments of the invention and that various changes and modifications may be made thereto without departing from the spirit and scope of the invention as defined in the appended claims.

What is claimed is:

1. A work apparatus comprising:

an air cooled combustion engine;

a cooling air blower having a fan wheel and a cooling air spiral having a base;

said cooling air blower being configured to generate a cooling air flow in a flow direction;

an air output window having a pass-through cross-section arranged in said base of said cooling air spiral;

a combustion air channel branching of from said air output window and leading from said cooling air blower to said combustion engine for conducting combustion air to said combustion engine in a flow direction;

a guide wall projecting into said cooling air spiral and extending between said fan wheel and said air output window; and, said pass-through cross-section of said air output window tapering in said flow direction of said combustion air from a first pass-through area to a second pass-through area;

wherein said guide wall has a roof section that overlaps said air output window at a distance (a); and, wherein said air output window has a radial back edge; said guide wall has a back end in said flow direction of said cooling air flow; said guide wail has a radial end section at said back end; said radial end section extends approximately along said radial back edge of said air output window; and, said radial end section forms an open pocket in which portions of the cooling air become trapped and thereby create a dynamic pressure above said air output window.

2. The work apparatus of claim 1, wherein said pass-through cross-section tapers continuously.

3. A work apparatus comprising:

an air cooled combustion engine;

a cooling air blower having a fan wheel and a cooling air spiral having a base;

said cooling air blower being configured to generate a cooling air flow in a flow direction;

an air output window having a pass-through cross-section arranged in said base of said cooling air spiral;

a combustion air channel branching off from said air output window and leading from said cooling air blower to said combustion engine for conducting combustion air to said combustion engine in a flow direction;

a guide wall projecting into said cooling air spiral and extending between said fan wheel and said air output window; and, said pass-through cross-section of said air output window tapering in said flow direction of said combustion air from a first pass-through area to a second pass-through area;

wherein said air output window has at least one edge configured as a surface sloping downward into said combustion air channel;

wherein said air output window has a longitudinal edge and said downward sloping surface is formed thereon; and, wherein said longitudinal edge lies opposite said guide wall.

4. The work apparatus of claim 3, wherein said downward sloping surface essentially defines an even plane.

* * * * *